US007464751B1

(12) United States Patent
Abel

(10) Patent No.: US 7,464,751 B1
(45) **Date of Patent: *Dec. 16, 2008**

(54) HIGH PRESSURE ADAPTER ASSEMBLY FOR USE ON BLOW OUT PREVENTERS

(76) Inventor: Leo William Abel, 2907 W. Lane Dr., Houston, TX (US) 77027

( * ) Notice: Subject to any disclaimer, the term of this patent is extended or adjusted under 35 U.S.C. 154(b) by 0 days.

This patent is subject to a terminal disclaimer.

(21) Appl. No.: 11/688,185

(22) Filed: Mar. 19, 2007

Related U.S. Application Data

(63) Continuation of application No. 11/021,774, filed on Dec. 22, 2004, now Pat. No. 7,334,634.

(60) Provisional application No. 60/541,074, filed on Feb. 2, 2004.

(51) Int. Cl.
*E21B 33/03* (2006.01)

(52) U.S. Cl. ..... 166/85.4; 166/90.1

(58) Field of Classification Search ..... 166/379, 166/85.4, 75.13, 85.1, 378, 90.1
See application file for complete search history.

(56) References Cited

U.S. PATENT DOCUMENTS 4,836,289 A 6/1989 Young
5,492,373 A 2/1996 Smith
5,605,194 A 2/1997 Smith
5,615,737 A 4/1997 Ables
6,209,652 B1 4/2001 Portman et al.
6,247,537 B1 6/2001 Dallas
6,364,024 B1 4/2002 Dallas
6,920,925 B2 7/2005 Duhn et al.
2003/0024709 A1 2/2003 Cuppen
2005/0211442 A1 9/2005 McGuire

*Primary Examiner*—Jennifer H Gay
*Assistant Examiner*—Robert E Fuller
(74) *Attorney, Agent, or Firm*—Buskop Law Group, PC; Wendy Buskop

(57) ABSTRACT

The high pressure adapter assembly for use in annular blow out preventers or other type BOPs has an upper and lower body with a bore that communicates between the upper and lower body; a top flange connected to the upper body for connection with a pressure control device; a side outlet port disposed in the upper body integrally connected to the bore, wherein the outlet port's side flange engage a line for pump-in or bleed-off of well fluids; a two-part self energizing hold down assembly with a male engagement section disposed between the upper and lower bodies; a flange for connecting to the two-part hold down assembly with a female engagement section for threadably engaging with the two-part hold down assembly's male engagement section; and a seal disposed between the male and female engagement sections and the lower body, wherein the lower body engages the annular seal of the BOP.

15 Claims, 5 Drawing Sheets

HIGH PRESSURE ADAPTER ASSEMBLY FOR USE ON BLOW OUT PREVENTERS

CROSS REFERENCE TO RELATED APPLICATION

This patent application is a continuation application that claims the benefit, under 35 USC § 120, of the prior non-provisional U.S. application Ser. No. 11/021,774, which was filed Dec. 22, 2004 and claimed priority to the co-pending provisional U.S. Application Ser. No. 60/541,074, filed Feb. 2, 2004. The prior co-pending non-provisional application is incorporated by reference along with its appendices.

FIELD

The invention relates to an adapter for use in wireline, snubbing and coil tubing assemblies for oil wells, natural gas wells, geothermal wells, water wells, preferably at the surface of the well.

The invention relates to a method for rapid installation of a smaller diameter pressure control device.

The installation is for use on an annular blow out preventer (BOP) or on top of any type of BOP, preferably on oil wells, natural gas wells, gas hydrate, sulphur, geothermal wells, water wells, injection wells and any mineral extraction via well bores in the earth, preferably at the surface of the well.

BACKGROUND

Currently, for oil and gas wells, blow out preventers are installed using a rig bell nipple that is solely for returning fluids to the storage area and not for pressure containment. When those nipples are removed, usually two individuals must climb up a BOP to undo about twelve bolts or more and remove the nipple. The BOP has limited space and is filthy and dirty with poor lighting. The individual must then get a high pressure adapter spool, energize the adapter by installing a high pressure gasket and installing bolts with high torque, and then cross over to the BOP. The usual work time required for these actions is between six and eight hours.

Other apparatus and methods for performing wireline operation in a well are described in Young U.S. Pat. No. 4,836,289, Ables U.S. Pat. No. 5,615,737, and Portman U.S. Pat. No. 6,209,652.

A need has existed for a system where people do not have to replace the bell nipple at odd and awkward times with a high pressure adapter. A need has existed for a system that can do such an installation in less than one hour, rather than six hours to eight hours and to remove the risk associated with the work required to remove the bell nipple and install a high pressure adapter spool piece. A need has existed for a system that reduces the risk of injury to personnel during installation of a high pressure spool piece.

BRIEF DESCRIPTION OF THE DRAWINGS

In the detailed description of the preferred embodiments of the assembly presented below, reference is made to the accompanying drawings, in which.

Figure 1:
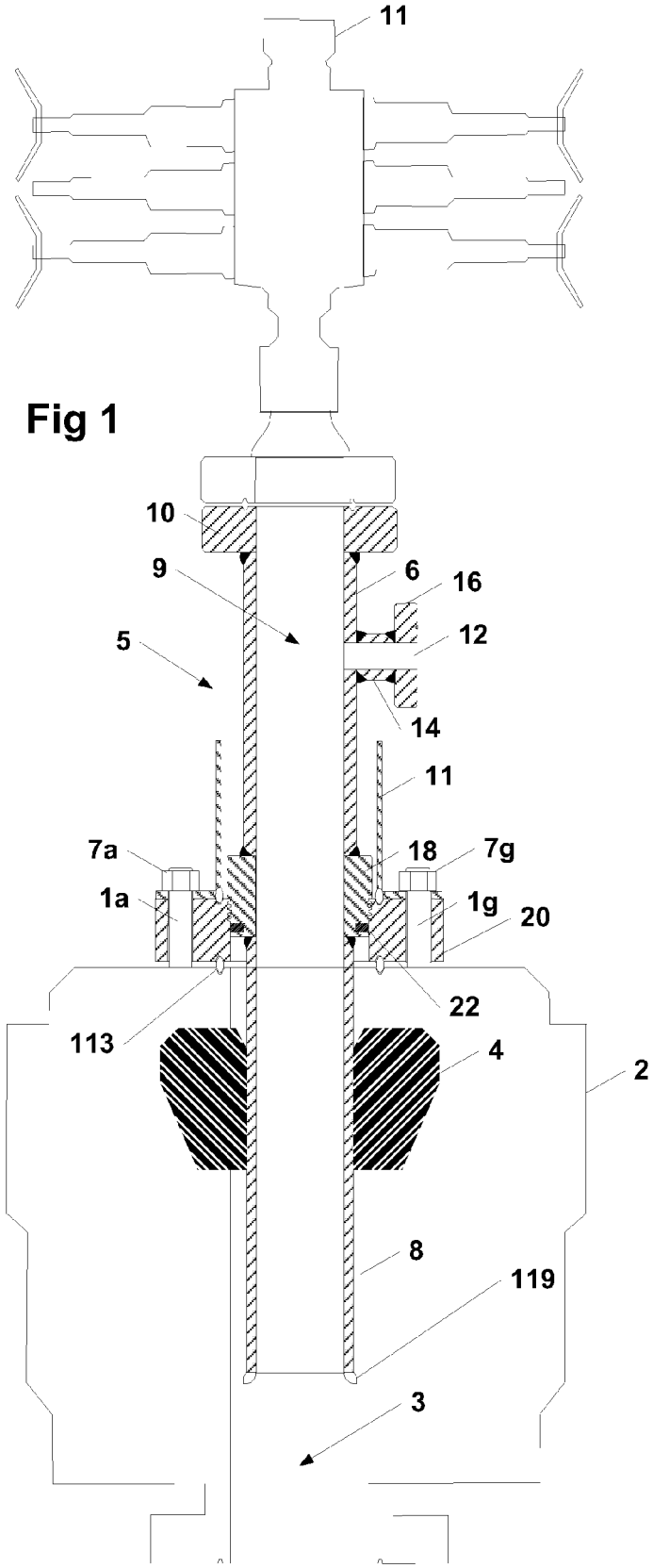
FIG. 1 depicts a side view of the shooting nipple assembly of the invention.

The present assembly is detailed below with reference to the listed Figures.

DETAILED DESCRIPTION OF THE PREFERRED EMBODIMENTS

Before explaining the present method in detail, it is to be understood that the method is not limited to the particular embodiments and that it can be practiced or carried out in various ways.

The present invention saves time in installing pressure control equipment for wireline operations. The invention can be used to save time in installing smaller bore pressure control equipment onto larger diameter BOPs, such as coil tubing, pumping, and reduced bore operations like fishing and pumping operations. The present invention adds a second and third flow barrier during the smaller bore operations that is a significant environmental advantage over all known system.

The present invention also has a dramatic improved safety feature of providing a second and third flow barrier or secondary pressure seals to prevent the release of oil, natural gas, or water in an uncontrolled manner.

The invention results in a dramatic decrease in the need for labor and exposure to hazards of climbing, performing heavy labor intensive work with bulky tools, working under a hoist, poor lighting and the generally dirty working environment for installation and de-installation of a rig bell nipple during the course of operation of the well.

The High Pressure Shooting Nipple (HPSN) is a device that reduces risks to personnel, the well and the environment. It also offers a means to increase the reliability of blow out preventers by allowing pressure testing for the upper section of the BOP, which is not normally done in non-HPSN applications.

The HPSN reduces the large BOP diameters to smaller diameters for wireline, snubbing, tie-back of casing for subsea applications and pumping operations in such a way that the full working pressure of the BOP is maintained for the small BOP operations (e.g., no compromise is made for pressure integrity). Other methods to reduce the time it takes to change the bell nipple are not full working pressure systems and therefore the advantage of the HPSN is its ability to work at full pressure and is still less likely to leak and create a health hazard or risk of pollution.

The HPSN has triple redundant pressure seals: lower cup testing type, annular element seal and lip seal in the hold down flange. A leak during drilling and work over operations can cause huge pollution risks, the triple redundancy of the HPSN dramatically reduces the risk of a leak thereby reducing pollution risks.

There is little risk that HPSN will be pushed out of the well when operating under pressure because it has structural integrity through its threaded attachment to the BOP that resists upward (pressure area effects) and downward forces (dead and live loads of equipment installed above) through the attachment bolts.

The HPSN uses very simple methods to install and remove the HPSN thereby eliminating risks of climbing to personnel or use of equipment and hammers to install large diameter bolts and nuts as is required in other methods. HPSN installs from above the BOP stack at the floor area usually and not under the rig in other applications therefore does not require climbing the stack in an inherently dirty and dark section of the rig, namely on top of the BOP stack. HPSN installs and removes in short order using a course type machine thread (8 to 12 turns of low torque to the right to install and the same amount of turns to the left to disengage and allow lifting out of the device).

Testing of the system at initial installation also tests the upper section of the BOP stack (namely the portion that is above the annular element which is the upper ring gasket and the cap seal of the annular BOP, or the upper section if installed on a BOP other than an annular type) which is useful in an emergency situation (like stacking up for snubbing operations) where additional BOP equipment is required over and above the initial installation.

With reference to the figures, FIG. 1 depicts a side view of high pressure adapter assembly 5 engaged with an annular blow out preventer (BOP) 2 having a bore 3 with annular seals 4. The adapter 5 can be short on land or very long when used offshore. It is contemplated that the adapter can be up to 4500 meters or more in length.

The high pressure adapter assembly includes an upper body 6 and a lower body 8 with a bore 9 that communicates between the upper and the lower body and the bore of the annular blow out preventer (BOP). The assembly has a top flange 10 connected to the upper body 6 that also connects to a pressure control device 11, such as a wireline BOP or a valve. The pressure control device 11 also can be a coiled tubing blow out protector, a base of a snubbing unit, or any other smaller bore BOP.

One of the features of the invention is to enable wireline operations to work in a safer and more reliable manner. Another feature of the invention is to enable drillers to reduce the working bore of a BOP of a well for various purposes. This improves the flexibility of drilling, making drilling more cost effective. The invention enables a large bore BOP, such as one with an 11 inch bore to be safely and easily connected to a smaller bore BOP such as 2 1/16 inch bore BOP, 3 1/16 inch bore BOP, 4 1/16 inch bore BOP, or 7 1/16 inch bore BOP.

A side outlet port 12 is integral with the upper body 6 and connects to the bore 9. The side outlet port 12 has a port body 14 and a side flange 16. The side flange 16 can engage a valve (not shown), and the valve then can engage a line that can be used for pump-in or bleed-off of well fluids for well control or testing procedures.

Figure 2:
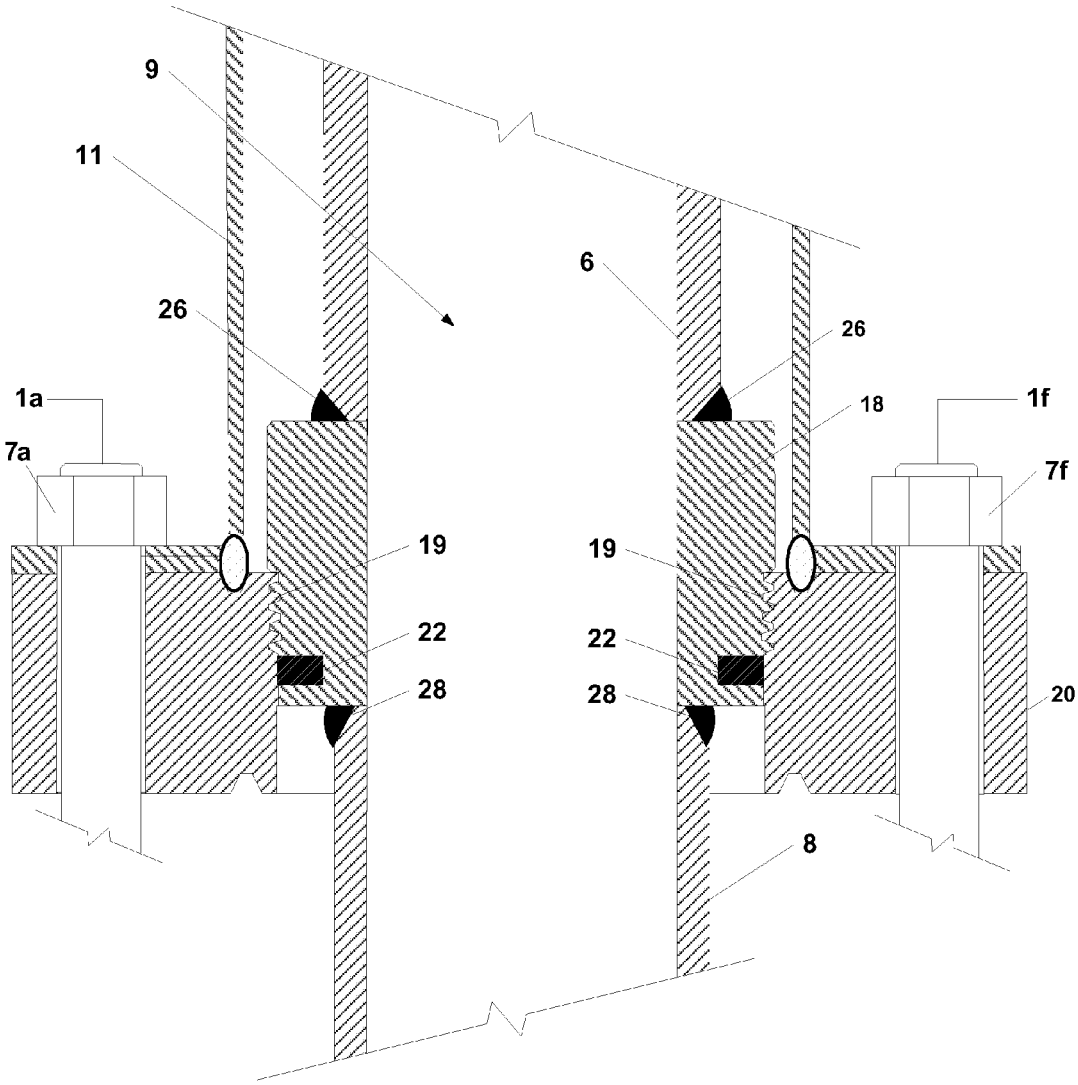
FIG. 2 depicts a detail from the side view of the shooting nipple assembly shooting the hold down assembly.

A two-part self energizing hold down assembly 18 having a male engagement section 19 shown in FIG. 2 is connected by welding or a threaded coupling between the upper body 6 and the lower body 8. The male section can be a threaded profile.

A flange 20 is used for connecting to the two-part self energizing hold down assembly 18. The flange 20 has a female engagement section 21 is shown in FIG. 2, for threadably engaging with the male engagement section 19.

A coarse buttress type thread having a pitch of four threads per inch is a preferred embodiment for the threaded engagement between the male engagement section and the female engagement section. It is possible to have a threaded engagement that is as few as two threads per inch, or as many threads as desired per inch for secure engagement. In an embodiment, eight threads per inch can be considered a normal maximum.

A seal 22 provides a pressure barrier to prevent fluids from passing out of the bore 3 of the well. Studs and nuts can be used to hold the flange 20 to the BOP 2. As shown, these studs and nuts energize a ring gasket seal 113 for increased environmental safety. FIG. 1 depicts only two studs 1*a* and 1*g* and two bolts 7*a* and 7*g*. The studs can be inserted into holes preferably having a 2-inch diameter for a preferred 19-inch bolt circle that can be used on an 11-inch 5000 psi designation BOP. Fewer stud holes and bolts can be used for smaller diameter BOP, and a larger number can be used for larger diameter BOP. In a preferred embodiment for an 11 inch, 5000 psi working pressure BOP, twelve studs and twelve bolts can be used to energize the ring gasket seal 113. A wireline reentry guide 119 can be used for the high pressure adapter assembly.

FIG. 2 depicts a detailed view of the two-part self energizing hold down assembly 18 that includes a seal 22 disposed between the threadably connected male engagement section 19 and female engagement section 20. In a preferred embodiment, seal 22 is a notch in the two-part self energizing hold down assembly 18 that is filled with an elastomer. This can be a self energizing elastomer. In a contemplated embodiment, the elastomer can be an O-ring. In another embodiment, the elastomer can be a combination of an O-ring or O-rings and lip seal type elastomeric sealing elements. It is contemplated that the seal 22 can be an elastomeric O-ring type seal.

FIG. 2 depicts a first weld 26 and a second weld 28 connecting the two-part self energizing hold down assembly 18 to the upper body 6 and the lower body 8, respectively. The upper body encloses the bore 9. The first weld 26 and the second weld 28 are preferably metal welds that are compatible with the alloy of the upper body 6 and the lower body 8, respectively. It is contemplated that the alloy material of the first weld can be a different material than that of the second weld, or the first weld and the second weld can be of the same material.

First weld 26 can be subject to bending stress and often must endure greater loads than second weld 28. For example, first weld 26 may need to be a type of material with a 110,000 psi yield strength material whereas second weld 28 may only need to be a type of material with an 80,000 psi yield strength. The flange 20 has a female engagement section 21 which threadably connects to the male engagement section 19. Two studs 1*a* and 1*f* and two bolts 7*a* and 7*f* are shown.

It is contemplated that the material used for this construction can have properties that resist corrosion and attack by well fluids and gases such as H2S, CO2, hydrocarbons, and gases normally found in production and exploration operations.

In an alternative embodiment, the welds can be replaced with casing type threads, and the hold down assembly can be threaded to the lower body and the upper body, which can provide for easier and faster assembly and improved structural integrity.

Figure 3:
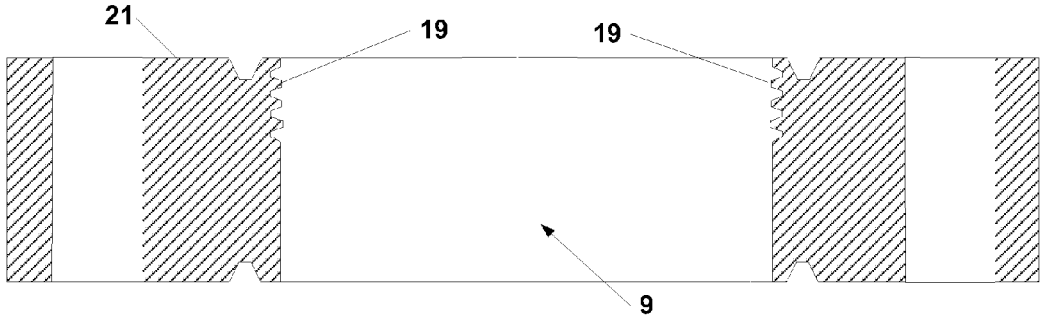
FIG. 3 depicts a test plug usable with the invention.

FIG. 3 depicts a test plug 142 that can be used prior to final installation of the high pressure adapter assembly. In a preferred embodiment, the test plug 142 is for engaging and testing the pressure integrity of the flange 20.

As shown in this FIG. 3, the test plug 142 has a pipe 132 with a bore 136 for connecting a cap 138 and a pipe pressure attachment 134. It is contemplated that the pipe pressure attachment 134 can be a testing flange or a hammer union. A testing seal 140 can be used instead of the seal 22 (shown in FIG. 2) of the hold down assembly.

Figure 4:
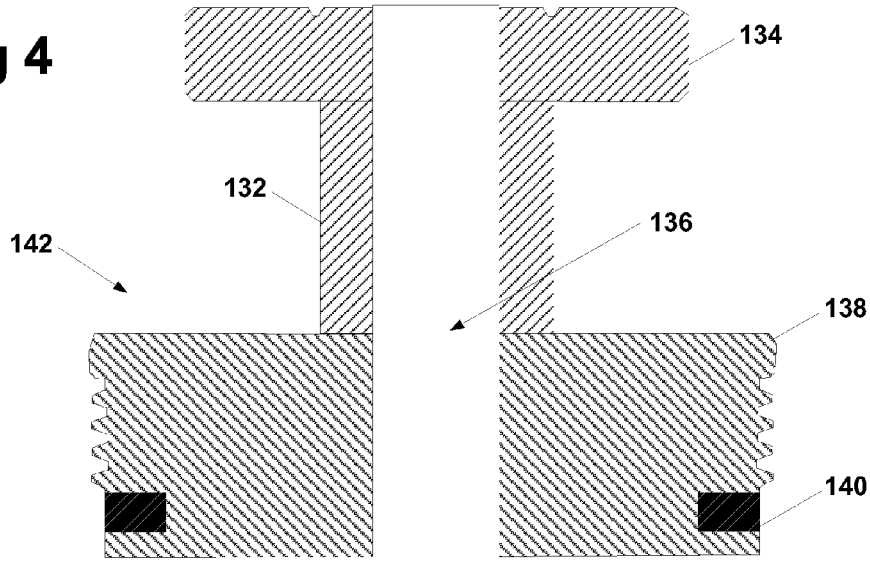
FIG. 4 depicts a lower seal assembly on the high pressure assembly.

FIG. 4 depicts an alternative embodiment of the assembly using a lower seal assembly secured to the lower body 8. FIG. 4 depicts all of the parts depicted in FIG. 1 with the addition of the parts of the lower seal assembly. This lower seal assembly provides a third seal to the annular BOP which enables a BOP to continue functioning when the upper seal of the upper part of the BOP is non-functional.

As shown in FIG. 4, the lower seal assembly includes an adapter 101 with threads 107 for connecting the adapter 101 to the lower body 8.

A seal 102 is disposed between the adapter 101 and the lower body 8 of the high pressure adapter. The seal 102 is preferably elastomeric. The seal 102 is even more preferably a lip type seal.

A cup type seal 103 having a first sealing element 104 and a second sealing element 106 is secured to the adapter 101 midway between the top of the adapter and the bottom of the adapter.

A wireline reentry guide 119 can be formed on the end of the adapter opposite the threaded end connecting to the lower body 8.

The shooting nipple assembly with lower seal assembly can be installed inside a riser, interior to a well casing, while allowing drilling and production operations to continue.

This embodiment, with the lower seal assembly, can be used in a short piece of pipe casing or with a long piece of casing with a high pressure riser to connect from the surface to depths up to 4500 meters or more.

This equipment enables a small BOP to be used with a large BOP intermittently through a drilling or work over operation.

The assembly can be used in bottom supported offshore platforms, as well as floating drilling and production platforms and operations. This assembly permits easy and fast installation of a small BOP over a large BOP compared to other known systems.

Figure 5:
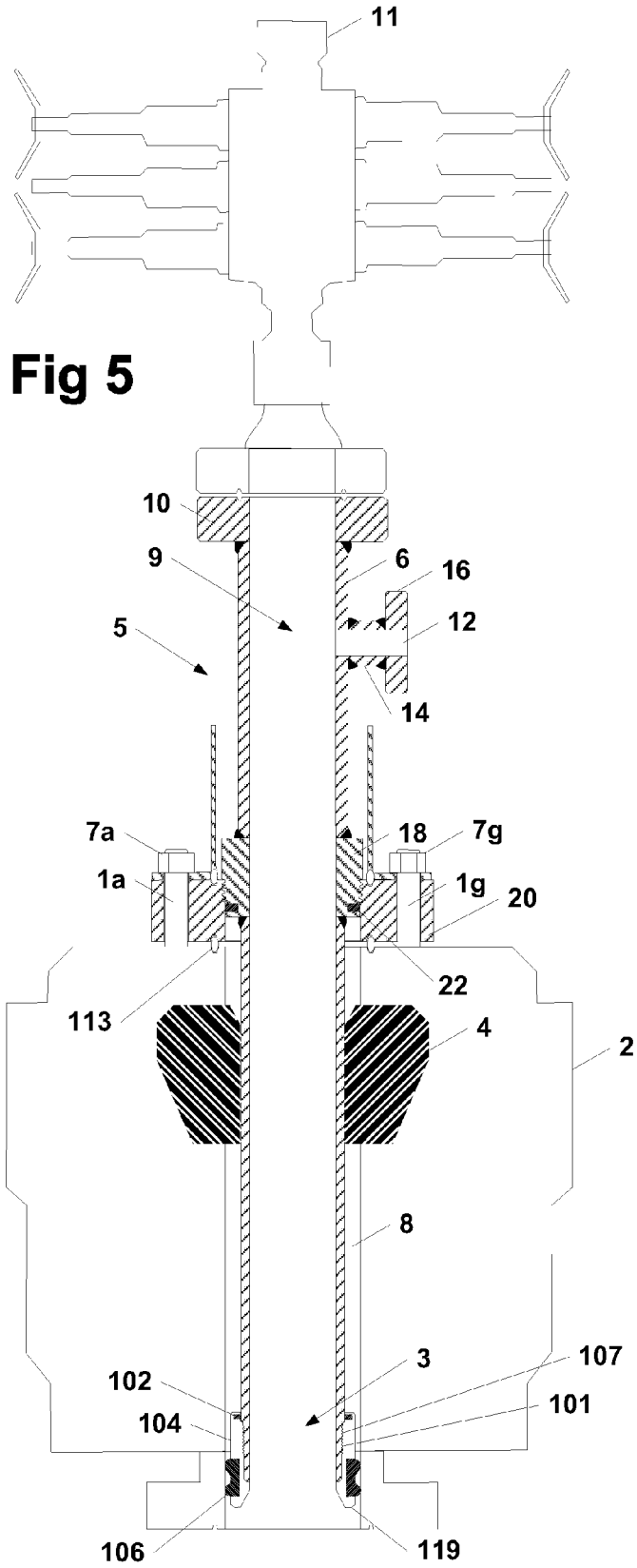
FIG. 5 depicts a detail of the lower seal assembly.
Figure 6:
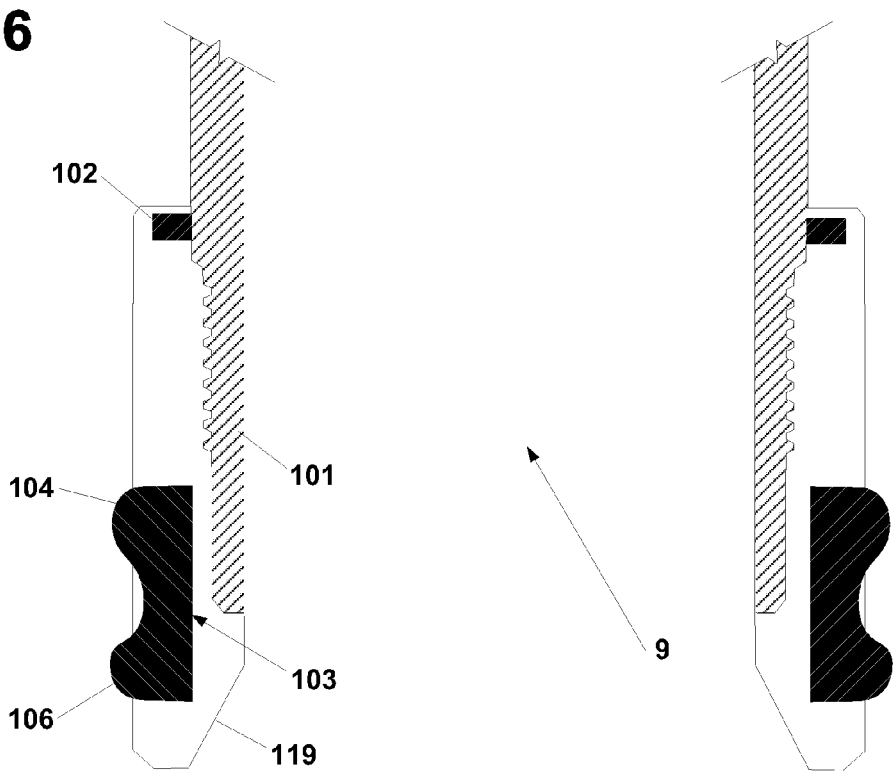

FIG. 5 depicts a cross-sectional detail of the lower seal assembly shown in FIG. 4. The cup type seal 103 having a first sealing element 104 and a second sealing element 106, is secured to the adapter 101 midway between the top of the adapter and the bottom of the adapter seals to the bore of the annular BOP. The cup type seal preferably has a really wide tolerance, so that if the bore is out of specification, such as being more oval than round, the cup type seal will adapt to the change and still yield and effective sealing engagement. A seal 102 is disposed between the adapter 101 and the lower body of the high pressure adapter. A wireline reentry guide 119 can be formed on the end of the adapter opposite the threaded end. The bore 9 is enclosed by the reentry guide 119.

In still another embodiment it is contemplated that a thread and seal protector can be installed on the hold down assembly to prevent damage to the threads and the seal area during normal drilling operations when the tool is not in use. The thread and seal protector is preferably made from steel.

It should be noted that the lower seal assembly can be installed without using much torque, preferably no more than 100 ft-lbs torque.

The assembly with lower seal assembly can be used in a 7 1/16$^{th}$ inch working bore, or BOPs with working bores including but not limited to a 3 and 1/16$^{th}$ bore, an 11 inch bore, a 13 and 5/8$^{th}$ inch bore, an 18 and 3/4 inch bore, 21 and 1/4 inch bore and a 30 inch bore.

In an alternative embodiment, the test plug may have a solid shaft instead of a pipe with a bore for testing purposes.

The assembly may further include a test seal that can be an elastomeric O-ring.

The assembly has been described in detail with particular reference to certain preferred embodiments thereof, but it will be understood that variations and modifications can be effected within the scope of the system, especially to those skilled in the art.

What is claimed is:

1. A high pressure adapter assembly for use in an annular blow out preventer comprising annular seals, the high pressure adapter assembly comprising:

a. an upper body and a lower body with a bore that communicates between the upper body and the lower body;

b. a top flange connected to the upper body for connection with a pressure control device;

c. a side outlet port disposed in the upper body, integrally connected to the bore having a port body and a side flange, wherein the side flange engages a line for pump-in or bleed-off of well fluids;

d. a two-part self energizing hold down assembly consisting of:

a male engagement member disposed between the upper body and the lower body;

a flange with a female engagement member for threadably engaging with the male engagement member of the two-part self energizing hold down assembly; and e. a seal disposed between the male engagement member and the female engagement member, wherein the lower body engages an annular seal of an annular blow out preventer.

2. The high pressure adapter assembly of claim 1, wherein the seal is a high pressure seal.

3. The high pressure adapter assembly of claim 1, wherein the two-part self energizing hold down assembly is welded to the upper body using a first weld and to the lower body using a second weld.

4. The high pressure adapter assembly of claim 3, wherein the seal is an elastomeric ring disposed around the male engagement member of the two-part self energizing hold down assembly.

5. The high pressure adapter assembly of claim 1, where the seal is a pressure barrier for working pressure from 5000 psi to 15,000 psi.

6. The high pressure adapter assembly of claim 1, wherein the high pressure adapter assembly comprises a steel alloy.

7. The high pressure adapter assembly of claim 1, wherein the high pressure adapter assembly is for a 7-inch to a 20-inch diameter annular blow out preventers.

8. The high pressure adapter assembly of claim 7, wherein the high pressure adapter assembly is for an 11-inch or a 13 5/8 inch working bore annular BOP.

9. The high pressure adapter assembly of claim 1, wherein the seal is an elastomeric O-ring.

10. The high pressure adapter assembly of claim 1, further comprising a wireline reentry guide disposed on the lower body for facilitating movement of wireline tools though the bore.

11. The high pressure adapter assembly of claim 1, wherein the flange can connect to a pressure control device with a smaller diameter bore than the annular blow out preventer.

12. The high pressure adapter assembly of claim 11, wherein the pressure control device with a smaller diameter bore can be a wireline blow out preventer, a coiled tubing blow out protector, a valve, a base of a snubbing unit, or any other smaller bore blow out preventer.

13. The high pressure adapter assembly of claim 1, further comprising a lower seal assembly threaded to the lower body of the high pressure adapter assembly.

14. The high pressure adapter assembly of claim 13, further comprising a wireline reentry guide formed from the lower seal assembly.

15. The high pressure adapter assembly of claim 13, wherein the lower seal assembly comprises:

a. an adapter having a top with threads for threadably engaging the lower body;

b. a seal disposed between the adapter and the lower body; and c. a cup type seal engaging the bore of the annular blow out preventer having a first sealing element and a second sealing element and wherein the midpoint is between the top of the adapter and the bottom of the adapter.

* * * * *